US009651009B2

(12) United States Patent
Ruβe et al.

(10) Patent No.: US 9,651,009 B2
(45) Date of Patent: May 16, 2017

(54) CONTROL METHOD FOR AN INJECTION VALVE AND INJECTION SYSTEM

(75) Inventors: Peter Matthias Ruβe, Tegernheim (DE); Anselm Schwarte, Bad Abbach (DE); Hans-Jörg Wiehoff, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 537 days.

(21) Appl. No.: 14/117,071

(22) PCT Filed: Apr. 18, 2012

(86) PCT No.: PCT/EP2012/057056
§ 371 (c)(1),
(2), (4) Date: Aug. 11, 2014

(87) PCT Pub. No.: WO2012/152552
PCT Pub. Date: Nov. 15, 2012

(65) Prior Publication Data

US 2014/0346244 A1 Nov. 27, 2014

(30) Foreign Application Priority Data

May 12, 2011 (DE) ..... 10 2011 075 732

(51) Int. Cl.
*F02M 51/06* (2006.01)
*F02D 41/20* (2006.01)
(Continued)

(52) U.S. Cl.
CPC ..... *F02M 51/0603* (2013.01); *F02D 41/2096* (2013.01); *F02D 41/2467* (2013.01);
(Continued)

(58) Field of Classification Search
CPC .... F02M 51/00; F02M 51/06; F02M 51/0603; F02D 35/02; F02D 35/023; F02D 35/025;
(Continued)

(56) References Cited

U.S. PATENT DOCUMENTS 6,340,858 B1 1/2002 Jaenker ..... 310/328
7,543,569 B2 6/2009 Remele et al. ..... 123/478
(Continued)

FOREIGN PATENT DOCUMENTS

CN 102027221 A 4/2011 ..... F02D 41/00
DE 19902413 C1 5/2000 ..... G05D 3/10
(Continued)

OTHER PUBLICATIONS

Chinese Office Action, Application No. 201280022940.X, 14 pages, Jun. 3. 2015.
(Continued)

*Primary Examiner* — Christopher Kim
(74) *Attorney, Agent, or Firm* — Slayden Grubert Beard PLLC

(57) ABSTRACT

A control method for a fuel injection valve for an internal combustion engine is disclosed, wherein at least one control signal for actuating a drive of the injection valve is generated in recurring injection cycles and as a function of a target stroke height of a closing element of the injection valve, wherein the drive is actuated by the control signal to lift the closing element to the target stroke height and the closing element is lifted to an actual stroke height by means of the drive, wherein at least one measured parameter correlated with the actual stroke height is captured and the actual stroke height is determined as a function of said at least one measured parameter, wherein the control signal is generated
(Continued)

in at least one of the subsequent injection cycles as a function of a deviation of the actual stroke height from the target stroke height.

9 Claims, 3 Drawing Sheets

(51) Int. Cl.
*F02D 41/24* (2006.01)
*F02D 35/02* (2006.01)
*F02D 41/14* (2006.01)

(52) U.S. Cl.
CPC ..... *F02D 35/023* (2013.01); *F02D 35/027* (2013.01); *F02D 2041/1419* (2013.01); *F02D 2041/2055* (2013.01); *F02D 2041/2058* (2013.01); *F02D 2200/0602* (2013.01); *F02D 2200/063* (2013.01)

(58) Field of Classification Search
CPC .... F02D 35/027; F02D 41/20; F02D 41/2096; F02D 41/2406; F02D 41/2425; F02D 41/2451; F02D 41/2464; F02D 41/2467; F02D 41/14; F02D 41/1401; F02D 2041/1413; F02D 2041/1418; F02D 2041/1419; F02D 2041/202; F02D 2041/2055; F02D 2041/2058; F02D 2200/06; F02D 2200/0602; F02D 2200/063
See application file for complete search history.

(56) References Cited

U.S. PATENT DOCUMENTS

| | | | | |
|---|---|---|---|---|
| 8,096,285 | B2 | 1/2012 | Rottenwöhrer et al. | 143/478 |
| 8,714,140 | B2 | 5/2014 | Borchsenius et al. | 123/494 |
| 2004/0255910 | A1 | 12/2004 | Joos et al. | 123/490 |
| 2006/0151628 | A1 | 7/2006 | Fekete et al. | 239/102.2 |
| 2006/0255302 | A1 | 11/2006 | Aspelmayr et al. | 251/129.06 |

FOREIGN PATENT DOCUMENTS

| | | | | |
|---|---|---|---|---|
| DE | 10114421 | A1 | 10/2002 | F02D 41/20 |
| DE | 10228353 | A1 | 1/2004 | F02M 65/00 |
| DE | 10323488 | A1 | 12/2004 | F02D 41/20 |
| DE | 102006059006 | B3 | 6/2008 | F02D 41/20 |
| DE | 102009029549 | A1 | 3/2011 | F02D 41/20 |
| WO | 03/081007 | A1 | 10/2003 | F02D 41/20 |
| WO | 2005/014991 | A1 | 2/2005 | F02D 41/20 |
| WO | 2006/087259 | A1 | 8/2006 | F02D 41/20 |
| WO | 2012/152552 | A2 | 11/2012 | F02D 41/20 |

OTHER PUBLICATIONS

International Search Report and Written Opinion, Application No. PCT/EP2012/057056, 15 pages, Aug. 11, 2012.

CONTROL METHOD FOR AN INJECTION VALVE AND INJECTION SYSTEM

CROSS-REFERENCE TO RELATED APPLICATIONS

This application is a U.S. National Stage Application of International Application No. PCT/EP2012/057056 filed Apr. 18, 2012, which designates the United States of America, and claims priority to DE Application No. 10 2011 075 732.5 filed May 12, 2011, the contents of which are hereby incorporated by reference in their entirety.

TECHNICAL FIELD

The invention relates to a control method for an injection valve for injecting fuel into an internal combustion engine, and to a corresponding injection system.

BACKGROUND

Such control methods serve to actuate injection valves in such a way that they are opened and closed again as exactly as possible at predefined times in order to inject as precisely as possible a predefined quantity of a pressurized fuel into the internal combustion engine. In this way, and, if appropriate, also by means of additional pre-injections and/or post-injections in addition to a main injection within one injection cycle, the efficiency of the internal combustion engine can be increased and at the same time exhaust gas emissions and noise emissions can be reduced.

An injection valve, frequently also referred to as injector, has a closing element which can be moved to open and close the injector by means of an actuator drive, referred to below in short as a drive. In the closed state of the injector, in which no injection takes place, the closing element is in a closed position, also referred to as a closing position, in which it closes off all the injection openings of the injector. The closing element can be raised starting from a closed position by means of the drive in order in this way to clear at least some of the injection openings and trigger the injection.

The closing element frequently has a nozzle needle or is configured as such. In its closing position, this nozzle needle then typically sits on what is referred to as a needle seat of the injector. The drive of the injector comprises, for the purpose of moving the closing element, an actuator which is typically configured to raise the closing element from the closed position to a stroke height as a function of a control signal, to hold said closing element at this stroke height and/or to move the closing element back into the closed position again. This actuator can, for example, be formed by a piezoelement which expands or contracts owing to electrical charging or discharging processes and in this way triggers a lifting or closing movement of the closing element. Such actuators which are also referred to as piezoactuators are particularly well suited for precise and delay-free movement of the closing element. This is the case in particular with what are referred to as directly driven (piezo) injectors in which direct and delay-free transmission of force between the piezoactuator and the closing element is made possible. Such a directly driven injector is known, for example from document EP 1 760 305 A1, the disclosure content of which is hereby completely incorporated.

When known control methods are used for injection valves in which injection valves of an injection system, for example of a common rail injection system, are actuated by means of control signals, it frequently proves problematic that identical injection valves within the injection system can differ in terms of their response behavior to the control signals. Differences in the opening behavior of the injection valves prove particularly problematic since they can have particularly strong effects on the quantity and time of injections.

Such differences can be caused, for example, by fabrication tolerances, progressive wear phenomena or other, possibly also time-dependent, interference influences. As a result of wear it is possible, for example, for play which becomes greater with time to come about between the piezoactuator and the closing element, with the result that the injection valve does not open with a precisely known deceleration until after the injection valve has been actuated. Document DE 10 2008 023 373 A1 describes, for example, a control method with which an idle stroke, which comes about owing to the abovementioned play between the piezoactuator and the closing element, can be taken into account and compensated. In this case the position of a maximum of a force profile of a force applied to the closing element by the piezoactuator is determined, and the time of the actual opening of the injection valve is inferred on the basis of the chronological position of this maximum. The position of the maximum of the force profile is subsequently used as a controlled variable of the control method and adjusted to a setpoint value.

In addition to the described idle stroke, the response behavior of the injector to the actuating signal can also depend on many further influencing factors and interference variables such as, for example, wear of further components, a nozzle body temperature, a fuel viscosity, a fuel pressure, a temperature of the piezoelement of the drive, as well as a prehistory of the piezoelement.

In addition to the most precise possible setting of the injection time and of the injection quantity, setting of an injection rate is also increasingly required. In this context, the fuel quantity injected per time unit will be referred to as the injection rate. These requirements demand a high control quantity of the control method, which also then has to be sufficient if the response behavior and, in particular, the opening behavior of an injector which is used changes over time and/or deviates from an expected behavior or a reference behavior of injectors of the same design. In particular, owing to deviating opening behaviors of individual injectors of an injection system it proves particularly difficult to achieve identical injection rates with the individual injectors of the system (identical setting).

SUMMARY

One embodiment provides a control method for an injection valve for injecting fuel into an internal combustion engine, wherein in each case at least one control signal for actuating a drive of the injection valve is generated in recurring injection cycles and as a function of a setpoint stroke height of a closing element of the injection valve, wherein the drive is actuated by the control signal in order to raise the closing element to the setpoint stroke height and the closing element is raised to an actual stroke height by means of the drive, wherein at least one measurement variable which is correlated to the actual stroke height is detected and the actual stroke height is determined as a function of this at least one measurement variable, wherein the control signal is generated in at least one of the subsequent injection cycles as a function of a deviation of the actual stroke height from the setpoint stroke height.

In a further embodiment, the drive has a piezoactuator for moving the closing element, and in that a charging current intensity, a charging voltage and/or a charging time for charging the piezoactuator are predefined by means of the control signal.

In a further embodiment, after actuation of the drive with the control signal an actual value of a measurement variable which characterizes a state of the drive is detected and a deviation of this actual value from a setpoint value of this measurement variable is taken into account in the generation of the control signal in at least one of the following injection cycles.

In a further embodiment, the actual value of the measurement variable which characterizes the state of the drive is used as a controlled variable of a subordinate control loop.

In a further embodiment, charging energy of a piezoactuator of the drive is used as a measurement variable which characterizes the state of the drive.

In a further embodiment, a piezoactuator of the drive is used to move the closing element and to measure at least one of the at least one measurement variables which is correlated to the actual stroke height.

In a further embodiment, at least one of the at least one measurement variables is measured, in that a time difference between a closing time, at which the closing element impacts in a closing position, and a preceding starting time of a closing movement of the closing element in the direction of the closing position is detected.

In a further embodiment, at least one of the at least one measurement variables which are correlated to the actual stroke height is measured in that an electrical capacitance is detected which a piezoactuator of the drive has at a time at which the closing element is at the actual stroke height.

In a further embodiment, at least one of the at least one measurement variables which are correlated to the actual stroke height is measured in that a pressure drop of the fuel which is triggered by the injection of the fuel is detected in the injection valve, a feed line to the injection valve and/or in a pressure accumulator.

In a further embodiment, at least one of the at least one measurement variables which are correlated to the actual stroke height is measured in that an injection rate of the fuel is measured by means of a through-flow sensor of the injection valve.

In a further embodiment, at least one of the at least one measurement variables which are correlated to the actual stroke height is measured in that a change in a rotation speed of the internal combustion engine which is triggered by the injection is detected.

In a further embodiment, at least one of the at least one measurement variables which are correlated to the actual stroke height is measured in that a change in a pressure in a cylinder of the internal combustion engine, which is triggered by the injection, is detected by means of a cylinder pressure sensor.

In a further embodiment, at least one of the at least one measurement variables is measured in that a solid-borne sound of the cylinder, which is triggered by combustion of the fuel injected into a cylinder of the internal combustion engine, is detected by means of a knocking sensor.

Another embodiment provides an injection system for injecting fuel into an internal combustion engine, comprising a control unit and at least one injection valve with a closing element for closing the injection valve, wherein the control unit is configured to generate, in recurring injection cycles and as a function of a setpoint stroke height of the closing element, in each case at least one control signal for actuating a drive of the at least one injection valve, wherein the drive is configured to raise the closing element to the setpoint stroke height as a function of the control signal, wherein the control unit is also configured to detect at least one measurement variable which is correlated to an actual stroke height of the closing element, to determine the actual stroke height as a function of this at least one measurement variable and subsequently to generate the control signal in at least one of the following injection cycles as a function of a deviation of the actual stroke height from the setpoint stroke height.

In a further embodiment, the drive has a piezoactuator and in that the control unit is configured to predefine, by means of the control signal, a charging current intensity, a charging voltage and/or a charging time for charging the piezoactuator.

In a further embodiment, the control unit is configured to determine at least one of the at least one measurement variables which are correlated to the actual stroke height using electrical signals generated by the piezoactuator.

In a further embodiment, the control unit is configured to determine the actual stroke height as a function of a time difference between a closing time at which the closing element impacts in a closing position, and a preceding starting time of a closing movement of the closing element in the direction of the closing position.

In a further embodiment, the control unit is configured to perform any of the methods disclosed above.

BRIEF DESCRIPTION OF THE DRAWINGS

Example embodiments of the invention are explained below in more detail with reference to the a drawings, in which.

DETAILED DESCRIPTION

Figure 1:
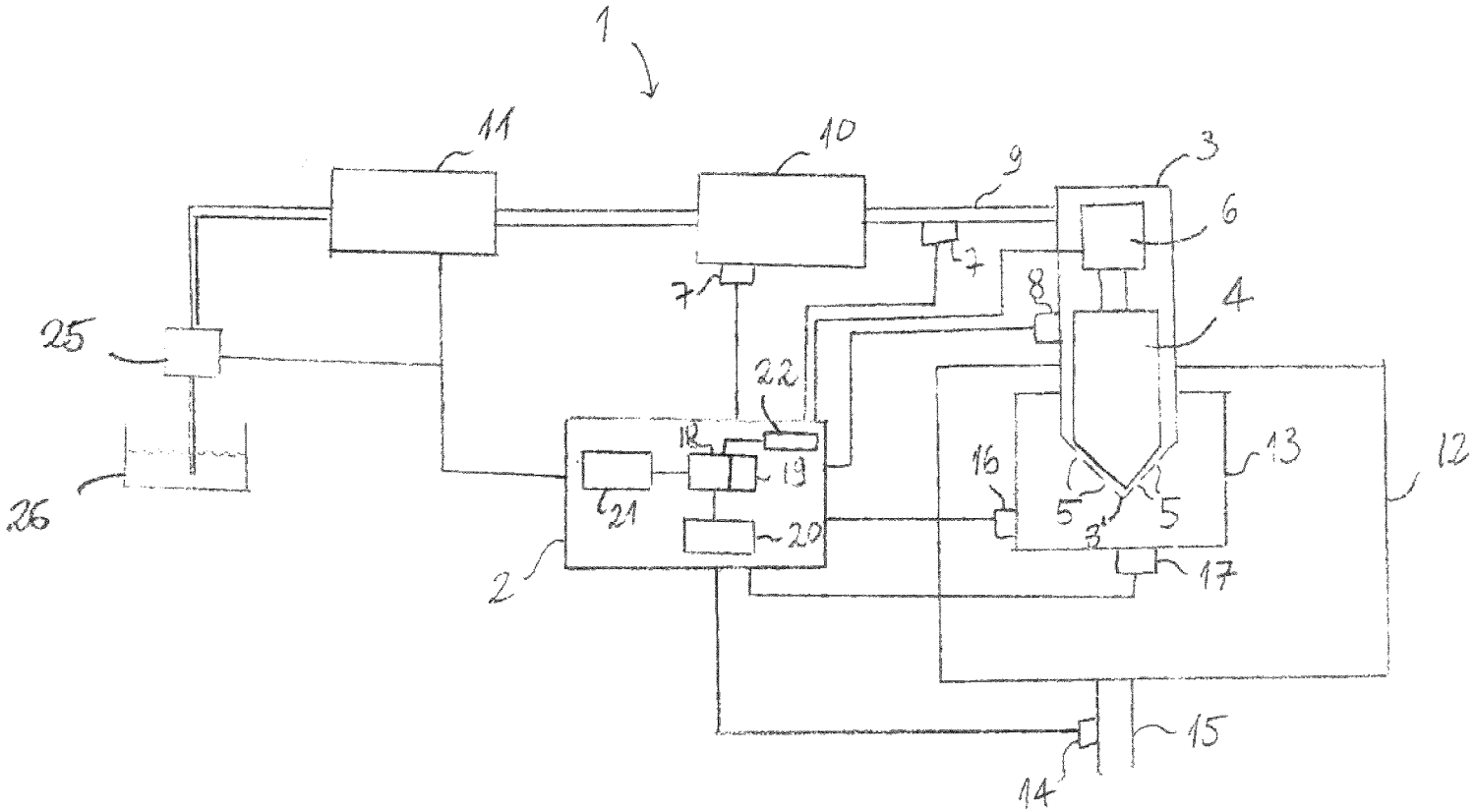
FIG. 1 shows an injection system of the type proposed here.

Embodiments of the present invention provide a corresponding control method for an injector for injecting fuel into an internal combustion engine, which method is defined by a particularly high control quantity and permits fuel to be injected into an internal combustion engine as precisely as possible by means of an injector. In this context, in particular the individual response behavior or opening behavior of the injector or injectors used is to be taken into account or compensated as well as possible. In addition to fabrication-related tolerances of the injector, time-dependent interference variables, like those mentioned above, in particular progressive wear or changes in temperature of the injector, are also to be compensated as completely as possible here. Furthermore, a corresponding injection system is to be proposed which is suitable for carrying out such a control method, which therefore permits the most precise possible actuation of an injector of the system and therefore particularly precise predefinition of injection quantities and injection times, wherein, in particular, injector-specific deviations of the response behavior or of the opening behavior of the injector from reference behavior of identical injectors is taken into account or compensated as well as possible.

In one embodiment, a control method for an injection valve for injecting fuel into an internal combustion engine provides that in each case at least one control signal for actuating a drive of the injection valve is generated in recurring injection cycles and as a function of a setpoint stroke height of a closing element of the injection valve, wherein the drive is actuated by the control signal in order to raise the closing element to the setpoint stroke height and the closing element is raised to an actual stroke height by means of the drive.

In some embodiments at least one measurement variable which is correlated to the actual stroke height is detected, for example by direct or indirect measurement, and the actual stroke height is determined as a function of this at least one measurement variable. Furthermore the control signal is generated in at least one of the subsequent injection cycles, preferably in the directly following injection cycle as a function of a deviation of the actual stroke height from the setpoint stroke height.

In one embodiment, an injection system for injecting fuel into an internal combustion engine is configured or equipped to carry out the disclosed method. Such an injection system accordingly comprises a control unit and at least one injection valve with a closing element for closing the injection valve, wherein the control unit is configured to generate, in recurring injection cycles, and as a function of a setpoint stroke height of the closing element, in each case at least one control signal for actuating a drive of the at least one injection valve. In this context, an injection cycle can contain one or more individual injections, for example a main injection and one or more pre-injections and/or secondary injections.

The drive is configured to raise the closing element to the setpoint stroke height as a function of the control signal. This setpoint stroke height is, however, virtually never achieved precisely but only with a certain degree of accuracy owing to production tolerances, wear and other disruptive influences which can never be completely avoided. The actual stroke height of the closing element is referred to as an actual stroke height.

In one embodiment, the control unit is configured to detect at least one measurement variable which is correlated to the actual stroke height of the closing element, by, for example, direct or indirect measurement, to determine the actual stroke height as a function of this at least one measurement variable and subsequently to generate the control signal in at least one of the following injection cycles, preferably in the directly following injection cycle, as a function of a deviation of the actual stroke height from the setpoint stroke height.

The specified setpoint stroke height is typically determined as a function of a degree of opening which is necessary to achieve a desired injection rate, preferably taking into account further operating parameters such as, for example, a pressure, a temperature and/or viscosity of the fuel. For what is referred to as a seat-throttled operating mode in which a specific throttling effect is to be applied to the fuel by the closing element and/or in which only some but not all of a plurality of injection holes of the injection valve are to be cleared, a setpoint stroke height is predefined which is smaller than a maximum stroke height of the injection valve. The maximum stroke height is frequently also referred to as the limiting stroke height and is typically defined by a mechanical stop of the closing element above the closed position of the closing element.

Embodiments of the invention are based on the realization that the individual opening behavior of a given injector can be characterized particularly precisely and reliably by the actual stroke height of the closing element achieved after the actuation of the injector, i.e. of the drive. Fabrication tolerances, wear and further influencing variables which can influence the opening behavior of the injector can be compensated particularly well using the specified deviation between the setpoint stroke height and the actually achieved actual stroke height in that subsequent actuation of the injector is correspondingly corrected. For this reason, by using this deviation as a control error it is possible to achieve a particularly robust control method for injectors, with which method precise injections and a high control quality can thus also be achieved with such injectors, the opening behavior of which injectors differs from that of a reference injector and/or changes over time, for example due to wear of the injectors.

The deviation between the actual stroke height and the setpoint stroke height itself is thus preferably used as a control error of the control method. This means that, as a function of the control error associated with a first actuation, that is to say the difference between the actual stroke height and the setpoint stroke height of this first actuation, subsequent actuations i.e. the control signals of the subsequent actuations, are corrected in such a way that the control errors of the subsequent actuations are smaller than the control error of the first actuation. In this way, precise injection of the fuel can be achieved without depending in this context on a reference-consistent and precisely predefined opening behavior of the injector.

The actual stroke height, that is to say the actually achieved stroke height of the closing element, determined by means of the specified correlated measurement variable or measurement variables, is also to be able to be provided by variables which themselves constitute a unique measure of the stroke height. In this context, the unit of this measure or of this variable does not have to be a length unit, but can, for example, also be, as described further below, a time unit or a pressure unit. In particular it is possible for this variable which serves or is used as a measurement of the stroke height to be identical to the specified correlated measurement variable or to one of the specified correlated measurement variables. In this case, this measurement variable is itself interpreted and used as an actual stroke height.

Measurement variables which are themselves influenced by the actual stroke height of the closing element which is actually achieved (after the actuation), that is to say depend in a physical-causal sense on the actually achieved stroke height are preferably considered as measurement variables which are correlated to the actual stroke height and which are used to determine the actual stroke height. A plurality of examples of this are specified further below. It is also possible to use a plurality of such variables to determine the actual stroke height. In this way, the actual stroke height can be determined particularly reliably, atypical values can more easily be detected and individual measuring errors can be made less significant.

At least one actuation variable of the drive is transmitted to the drive by means of the specified control signal. In one embodiment, the drive has a piezoactuator for moving the closing element. A charging current intensity, a charging voltage and/or a charging time for charging the piezoactuator is then predefined as a manipulated variable by means of the control signal and transmitted to the piezoactuator. The injector is preferably a directly driven piezoinjector in which, as described above, a direct and virtually delay-free transmission of force is therefore implemented between the piezoactuator and the closing element. However, in principle it is also possible to provide a magnet actuator. In one particularly preferred development, the control unit is configured to determine at least one of the at least one measurement variables correlated to the actual stroke height, using electrical signals generated by the piezoactuator. In this context, the piezoactuator of the drive therefore additionally serves as a sensor, that is to say as a piezosensor, for measuring this measurement variable. An example of this is described further below.

In one embodiment, after the actuation of the drive with the control signal, an actual value of a measurement variable is detected which characterizes the drive, for example an instantaneous state, an instantaneous state of movement or an instantaneous dynamic state of the drive. The state of the drive is preferably one which is present chronologically before the actual stroke height achieved, with the result that the actual stroke height preferably depends in a physical-causal sense on the actual value of the measurement variable which characterizes this state. In at least one of the following injection cycles, a deviation of this actual value from a setpoint value of this measurement variable is taken into account in the generation of the control signal. The control unit can be configured in accordance with this. In this context, it is possible to provide that the actual value of this measurement variable is used as a controlled variable of a subordinate control loop of the control method. It is possible to provide, for example, that charge energy of a piezoactuator of the drive or else a chronological force profile of the drive or a characteristic variable of this force profile, such as for example a force maximum, is used as such a measurement variable. The use of a force maximum as a controlled variable of a control method for an injector for compensating an idle stroke and associated decelerations in the opening behavior has already been described at the beginning.

Particularly robust cascade control can be implemented by using the measurement variable which characterizes the state of the drive, in particular when the achieved actual needle stroke depends on the actual value of this measurement variable which characterizes the drive. During such cascade control, the control method includes the control of the measurement variable which characterizes the drive, as a further "subordinate" control loop. In this context, the needle stroke is preferably used as a controlled variable of an "outer" control loop of the method, and the state of charge or charging energy of the piezoactuator is used as a controlled variable of the subordinate control loop. For this purpose, the control unit can be configured accordingly. This will be described further below with reference to a specific exemplary embodiment.

The measurement of the actual value of the measurement variable which characterizes the drive will preferably be performed as far as possible directly after actuation of the injector, preferably at least once per injection cycle, particularly preferably after each individual actuation of the injector.

In one embodiment, the injection system comprises a needle stroke sensor with which the actual needle stroke is measured directly. In order to eliminate the additional costs incurred with such a needle stroke sensor, other measurement variables which are correlated to the actual needle stroke are, however, preferably measured and used to determine the actual needle stroke. In the text which follows a number of examples of this are described, but not conclusively.

In one embodiment, at least one of the at least one measurement variables, which are correlated to the actual stroke height, is measured as a time difference between a closing time, at which the closing element impacts in a closing position, and a predefined starting point of a closing movement of the closing element in the direction of the closing position. In this context, the closing movement is triggered with the drive at the starting time. The starting time of the closing movement can be determined using the actuation of the drive with a corresponding control signal to trigger this closing movement.

The closing time is preferably detected by the piezoactuator itself by virtue of the fact that an electrical signal which is triggered by the impact of the closing element in the closing position in the piezoactuator is measured and is evaluated with the correspondingly configured control unit. The specified time difference is the duration of the closing movement, that is to say the time which the closing element took to return from the actual stroke height to the closed or closing position. Since there is therefore a unique relationship between this time difference and the actual stroke height, this time difference can itself be used as a measure for the actual stroke height. However, it is also possible to provide that the actual stroke height is determined from this time difference in a further method step, either by using a corresponding (time-integrated) movement equation, into which the time difference is inserted, or by using a corresponding characteristic diagram in which value pairs of time differences and associated actual stroke heights as well as, if appropriate, further operating parameters such as, for example, the temperature and the pressure of the fuel are stored. The control unit can be correspondingly configured for this purpose.

It is also possible to provide that at least one of the at least one measurement variables, which are correlated to the actual stroke height, is provided by an electrical capacitance which the piezoactuator of the drive has at a time at which the closing element is at the actual stroke height. This capacitance for the time directly after the stroke movement is preferably determined at the end of the actuation signal for the stroke movement or at the starting time of the closing movement, that is to say directly before the control signal for triggering the closing movement. In this context, the capacitance can be calculated using the known formula $C=Q/U$ or $C=\text{integral}[I(t)dt]/U$, wherein, for example, integration is performed over the duration of a preceding charging time and, if appropriate, of a subsequent holding period of the closing element at the actual stroke height during an injection cycle. The capacitance itself is therefore then not measured directly but instead the time profile of a charging current or discharging current of the piezoactuator and an electric voltage present at an actuator are measured.

In addition it is possible that at least one of the at least one measurement variables, which are correlated to the actual stroke height, is measured as an injection rate of the fuel by means of a through-flow sensor of the injection system. Subsequently, the actual stroke height during the injection is then determined as a function of the injection rate. The control unit can be correspondingly configured for this purpose.

It is also possible to provide that at least one of the at least one measurement variables, which are correlated to the actual stroke height, is measured, in that a pressure drop of the fuel which is triggered by the injection of the fuel, is detected in the injection valve, a feed line to the injection valve and/or in a pressure accumulator, and the injected quantity, the injection rate and finally the actual stroke height are calculated therefrom.

Furthermore, the injection system can comprise a pressure sensor for measuring the specified drop in pressure. It is also possible to provide that at least one of the at least one measurement variables, which are correlated with the actual stroke height, is detected as a change in a rotational speed of the internal combustion engine which is triggered by the injection. This change in a rotational speed can be determined, for example, by means of a rotational speed sensor which is typically arranged on a drive axle or connecting rod of the internal combustion engine. The injected fuel quantity, the injection rate and finally the actual stroke height can be calculated from the change in the rotational speed.

It is also possible that, by means of a cylinder pressure sensor of the injection system, at least one of the at least one measurement variables, which are correlated with the actual stroke height, is measured as a change in a pressure in a cylinder of the internal combustion engine which is triggered by the injection. The injected fuel quantity, the injection rate and finally the actual stroke height can be calculated back from the change in pressure.

Finally, at least one of the at least one measurement variables can be measured as a solid-borne sound of the cylinder, which is triggered by combustion of the fuel injected into a cylinder of the internal combustion engine, by means of a knocking sensor of the injection system. The injected fuel quantity, the injection rate and finally the actual stroke height can be calculated back from the intensity of the solid-borne sound.

Subsequently, the injection rate can therefore be determined as a function of the specified measurement variables, wherein the actual stroke height can be determined during the injection as a function of the injection rate. For this purpose, further operating parameters such as, for example, the viscosity and the temperature of the fuel are preferably taken into account. The control unit can be correspondingly configured to carry out the evaluation of the respective measurement signals and to carry out the necessary computing operations.

The formulation "be configured" is intended to be able to mean in the case of the control unit that a corresponding programmed device or corresponding programming of the control unit is present. For this purpose, the control unit typically has a suitable storage medium and a computing unit, if appropriate further storage media and corresponding data interfaces for carrying out the respective, described method steps for which the control unit is to be respectively configured. In the case of the drive or of other mechanically acting components of the system, the formulation "be configured" can be understood as meaning a corresponding configuration, embodiment, design of the respective component or a mechanical or signaling operative connection of this component with other components of the system, in particular with the control unit.

FIG. 1 is a schematic illustration of an injection system 1 of the type proposed here, which injection system 1 is configured to carry out a specific embodiment of the control method proposed here. The system 1 comprises a control unit 2 and a multiplicity, of, for example four, identically embodied injection valves 3, but for the sake of clarity just one of these is illustrated here and described below. Likewise, the programmed device of the control unit is described only with respect to this one injection valve 3 even though there is also corresponding programming with respect to the further injection valves. As a result, the method steps described here, see also FIG. 2, also relate to any individual injection valve of the injection valves of the injection system 1.

The injection valve 3 has in each case a closing element 4 which is embodied as a nozzle needle and has the purpose of opening and closing injection openings 5 of the injection valve 3, which injection openings 5 are arranged in various planes. The injection valve is therefore embodied as what is referred to as a vario nozzle. Depending on the actual stroke height of the nozzle needle it is therefore possible to open many of the injection openings 5 through which fuel is then injected, and other injection openings 5 which are arranged higher remain closed.

If not all of the injection openings 5 are opened, the injection valve is typically in a seat-throttled operating mode. For such an operating mode, a setpoint stroke height is predefined which is lower than a maximum stroke height, defined by a mechanical stop, of the injection valve. A degree of opening of the injection valves is therefore set by means of the actual stroke height. The control unit 2 is configured to determine, depending on the desired injection rate, the associated degree of opening of the injection valve 3 as a function of a temperature, a viscosity and a pressure of the fuel, and to calculate from this degree of opening a setpoint stroke height of the closing element 3 which is required to achieve this degree of opening.

The control unit 2 is also programmed to generate, in recurring injection cycles and as a function of the calculated setpoint stroke height, in each case at least one control signal for actuating a drive 6 of the injection valve 3. In each injection cycle, a plurality of individual injections can be carried out by means of successive control signals, which individual injections can differ from one another in terms of their injection quantity and their chronological injection rate profile as a function of the respective control signal.

Manipulated variables of the drive 6 are defined with the control signal as a function of the setpoint stroke height and are transmitted to the drive 6. In the example shown, the drive is provided by a piezoactuator. A charging time of the piezoactuator is used as the manipulated variable. Alternatively or additionally to the charging time, an adjustable charge voltage and/or an adjustable charging current could also be used as manipulated variables. The drive 6 is configured to raise the closing element to the setpoint stroke height as a function of the control signal. In this context, the control signal electrically charges the piezoactuator up to a charging energy which depends, in particular, on the charging time, with the result that the piezoactuator expands owing to the piezo effect and the closing element is subjected to a lifting movement as far as the actual stroke height. The injection valve is a directly driven piezoinjector in which a direct and virtually delay-free transmission of force is ensured between the drive 6 and the closing element.

Owing to production tolerances and wear of the injection valve, in particular of the closing element 4 and a needle seat 3' on which the closing element 4 is seated in its closed position, as well as other interference variables already specified, the desired setpoint stroke height is reached precisely only rarely. This means that between the actually achieved actual stroke height of the closing element 4 and the setpoint stroke height there is generally a deviation. The control unit 2 is therefore also configured to detect a plurality of measurement variables which are correlated to the actual stroke height of the closing element 4 and which are each influenced by the actually achieved actual stroke height and depend thereon. The control unit 2 is also configured in terms of programming technology to determine the actual stroke height as a function of these measurement variables and subsequently generate the control signal of at least one of the subsequent individual injections of the subsequent injection cycles as a function of the deviation of the actual stroke height from the setpoint stroke height. In this context, the deviation between the actual stroke height and the setpoint stroke height is used as a control error of the control method, i.e. the control signals of the subsequent actuations are corrected in such a way that the following control errors are reduced.

The control unit 2 is configured to actuate the drive 6 to close the injection valve 3. Owing to a corresponding control signal, which is provided in this example by a discharge current which brings about discharging and contraction of the piezoactuator, the closing element 4 is made to undergo a closing movement in the direction of the closing position, that is to say in the direction of the needle seat 3'. When the closing element 4 impacts on the needle seat 3', a rebound is transmitted to the piezoactuator, which rebound triggers an electrical pulse in the piezoactuator 6. The control unit 2 is configured to determine the closing time using this electrical pulse. The specified electrical pulse is therefore a measurement signal which signals the closing time. The piezoactuator therefore serves additionally as a sensor for detecting the impacting of the closing element in the closed position. Subsequently, the control unit 2 calculates the time difference between the starting point of the closing movement, which starting point is given by the time of transmission of the corresponding control signal, and the closing time. This time difference is used as a measure for the actual stroke height. Additionally or alternatively, it would also be possible to provide that the actual stroke height itself is determined from this time difference, for example by means of a movement equation or on the basis of corresponding characteristic diagrams, as has been described further above.

Furthermore, by means of the control unit 2 a capacitance of the piezoactuator of the drive 6 is determined, which the piezoactuator has directly before the control signal at the starting time of the closing movement. The capacitance is calculated using the known formula $C=\int[I(t)dt]/U$, wherein integration is carried out from the starting time of the lifting movement up to the starting time of the subsequent closing movement.

In addition, an injection rate of the fuel is measured by means of a through-flow sensor 7, assigned to the injection system, of the injection system 1, and the actual stroke height during the injection is determined with the control unit 2 as a function of the injection rate.

In the injection valve 3, a pressure drop of the fuel in the injection valve, triggered by the injection of the fuel, is detected with a pressure sensor 8 of the injection valve 3. It is also possible for (further) pressure sensors to be arranged on a feed line 9, which connects a pressure accumulator 10 to the injection valve, on the pressure accumulator 10 or on a high pressure pump 11 of the injection system 1, in order to measure corresponding changes in pressure of the fuel at these components. In principle, such pressure sensors or through-flow sensors could also be arranged at a pre-feed pump 26 with which the fuel is conveyed from a tank 26 to the high pressure pump 25.

Furthermore, a change, triggered by the injection, in a rotational speed of an internal combustion engine 12 is detected, in the cylinder 13 of which the fuel is injected with the injection valve 3. This change in the rotational speed is measured with a rotational speed sensor 14 which is arranged on a drive axle 15 of the internal combustion engine 12.

A change in a pressure, triggered by the injection, is additionally detected with a cylinder pressure sensor 16 of the system arranged on the cylinder 13. Furthermore, a knocking sensor 17 of the system 1, with which a solid-borne sound of the cylinder, triggered by combustion of the fuel injected into the cylinder 13, is measured, is arranged at the cylinder.

The injection rate of the respective injection is determined as a function of the specified measurement variables by means of the correspondingly programmed control unit 2, and in each case the associated actual stroke height is subsequently calculated as a function of the injection rate, wherein further operating parameters such as, in particular, the viscosity and the temperature of the fuel are taken into account. The control unit is connected to the sensors 6, 7, 8, 14 and 16 for the transmission of signals, and is configured in terms of programming technology to evaluate the respective measurement signals of these sensors and for the necessary computing operations in order to determine the actual stroke height from the measurement signals. Furthermore, the control unit 2 is configured to check the above-mentioned time difference using the actual stroke heights calculated in this way, and if appropriate to correct the value of the time difference.

In a simpler embodiment, the actual stroke height is determined using the described time difference between the starting time of the closing movement and the closing time and/or using the capacitance of the piezoactuator, without the measured values of the sensors 7, 8, 14, 16 and 17 being used in the way described above. These sensors 7, 8, 14, 16 and 17 can then be dispensed with, as a result of which a simpler design of the system can be achieved.

In addition, after each actuation of the drive 5 an actual value of charging energy of the piezoactuator of the drive 5 is detected, that is to say a measurement variable which characterizes an instantaneous state of the drive. The measurement of the actual values of this measurement variable characterizing the drive is performed as directly as possible after each actuation of the drive.

The actual value of the charging energy is subsequently used as a controlled variable of a subordinate control loop of the control method, cf. also FIG. 2 and the associated description below. A deviation of the actual value of the charging energy from a setpoint value of the charging energy is interpreted here as a control error of the subordinate control loop, and is used to correct the control signal or the manipulated variable for the drive, that is to say in this case the charging time of the piezoactuator, for a subsequent individual injection in such a way that the control error of the subordinate control loop is reduced. On the other hand, the setpoint value of the subordinate control loop, that is to say the setpoint charging energy of the piezoactuator is (under certain circumstances) corrected as a function of the control error of the stroke height, that is to say the deviation of the actual stroke height, achieved by the actuation of the drive 6, from the setpoint stroke height, in such a way that a control error of the stroke height is reduced. This correction of the setpoint value of the subordinate control loop therefore indirectly brings about correction of the manipulated variable.

Figure 2:
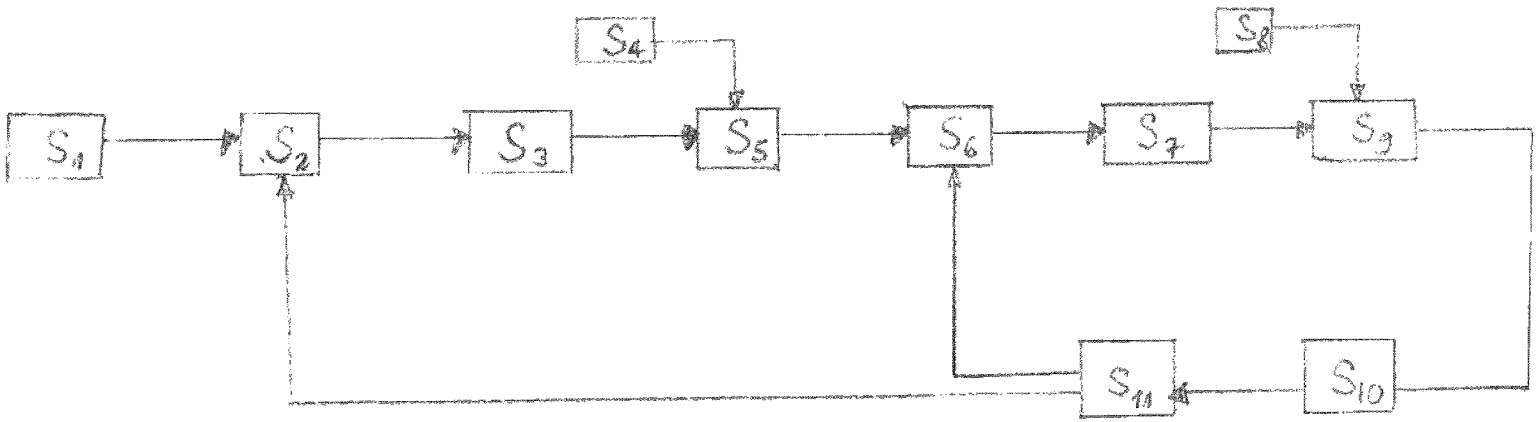
FIG. 2 shows method steps of a control method of the type proposed here.

The control method is therefore carried out in this example in the form of a cascade control process, see also FIG. 2, in which the setpoint value of the charging energy depends on the actual stroke height and the setpoint stroke height. If, for example, the actual stroke height is lower (or higher) than the setpoint stroke height, that is to say if the value of the associated control error is positive (or negative), the setpoint value of the charging energy is subsequently raised (or lowered) for the next actuation of the drive. Subsequently, the control signal is determined as a function of the raised (or lowered) setpoint value of the charging energy in such a way that the value of the manipulated variable, that is to say the charging time, is correspondingly increased (or reduced), with the result that in this way a higher (or lower) actual needle stroke and therefore a smaller control error between the actual needle stroke and the setpoint needle stroke is achieved at the next actuation of the drive, see also FIG. 3.

In order to carry out the described method steps, the control unit 2 comprises a computing unit 18 with a data memory 19 with implementation of the control method by means of programming technology, and a first PI controller 20 and a second PI controller 21.

FIG. 2 illustrates schematically some of the steps of this specific, cascade-like implementation of the proposed control method which are described above. In the first step S1, the associated setpoint stroke height is firstly determined with the computing unit 18 in the form of the time difference described above, as a function of the desired injection rate of a subsequent individual injection. In the second step S2, this time difference of the setpoint stroke height is compared with the time difference of the actually achieved actual stroke height of a preceding individual injection, and the control error between the individual stroke height and setpoint stroke height, that is to say the difference between the two associated time differences, is calculated. The actual stroke height may be, for example, the actual stroke height of the directly preceding individual injection if the same setpoint stroke height was prescribed for the latter. Otherwise, an actual stroke height, stored in the data memory 19, of a preceding individual injection for which the same setpoint stroke height was determined is used.

A correction value for pilot-control charging energy of the piezoactuator is determined with the first PI-controller 20 as a function of the calculated control error. This pilot-control charging energy is read out in step S4 from a pilot-control characteristic diagram, stored in the data memory 19, as a function of the setpoint stroke height. In step S5, the specified correction value of the first PI controller is added by the computing unit 18 to the pilot-control value of the charging energy. The setpoint value of the charging energy for the subordinate control loop is obtained from this.

In step S6, the control error between this setpoint value of the charging energy and an actual value of the charging energy which is measured in the above-mentioned, preceding individual injection is determined with the computing unit 19. In step S7, a correction value for a pilot-control value of the charging time is determined with the computing unit 18 by means of the second PI controller 21 as a function of this control error. In step S8, the pilot-control value for the charging time is read out from a pilot-control characteristic diagram, stored in the data memory 19, as a function of the setpoint value of the charging energy. In step S9, this correction value and the pilot-control value are combined to form a manipulated value of the charging time with the computing unit 18. In step S10, a control signal in the form of a charging current pulse whose length corresponds to this charging time is generated with an output stage 22 of the control unit 2 and transmitted to the piezoactuator of the drive 6, with the result that the piezoactuator is charged to a new actual charging energy level. This charging of the piezoactuator triggers a change in length of the piezoactuator, and the closing element 4 is raised to a new actual stroke height.

In a somewhat simpler, but nevertheless robust, embodiment of the control method, the subordinate control of the charging energy described above is dispensed with. Then, the value of the manipulated variable, that is to say the charging time, is directly corrected as a function of the control error between the setpoint stroke height and the actual stroke height in such a way that the control error of a subsequent injection is reduced. The steps S6 to S9 are therefore eliminated, wherein in step S3 the correction value for the charging time is determined with the computing unit 18 by means of the PI controller 20 as a function of the control error between the actual stroke height and the setpoint stroke height, and in step S4 a pilot-control value for the charging time is read out, as a function of the setpoint stroke height, from a pilot-control characteristic diagram stored in the data memory 19. In step S5, the resulting value of the charging time is calculated from the correction value and the pilot-control value. Steps S10 and S11 are then as described above.

In the described control method, correction values with which setpoint values or control variables read out from pilot-control characteristic diagrams, for the charging energy or charging time in the examples shown, are corrected are determined as a function of the detected control errors. In the exemplary embodiment described here, the transmission behavior of the PI controllers 20 and 21 is not changed. In principle, this is, of course, also possible. It is therefore possible, for example, to provide that the transmission behavior or the transmission functions of the controllers used is automatically adapted as a function of the detected control errors to the opening behavior of the injectors which changes over time or to other interference variables which are variable over time, that is to say that what is referred to as an adaptive control method is carried out.

Figure 3:
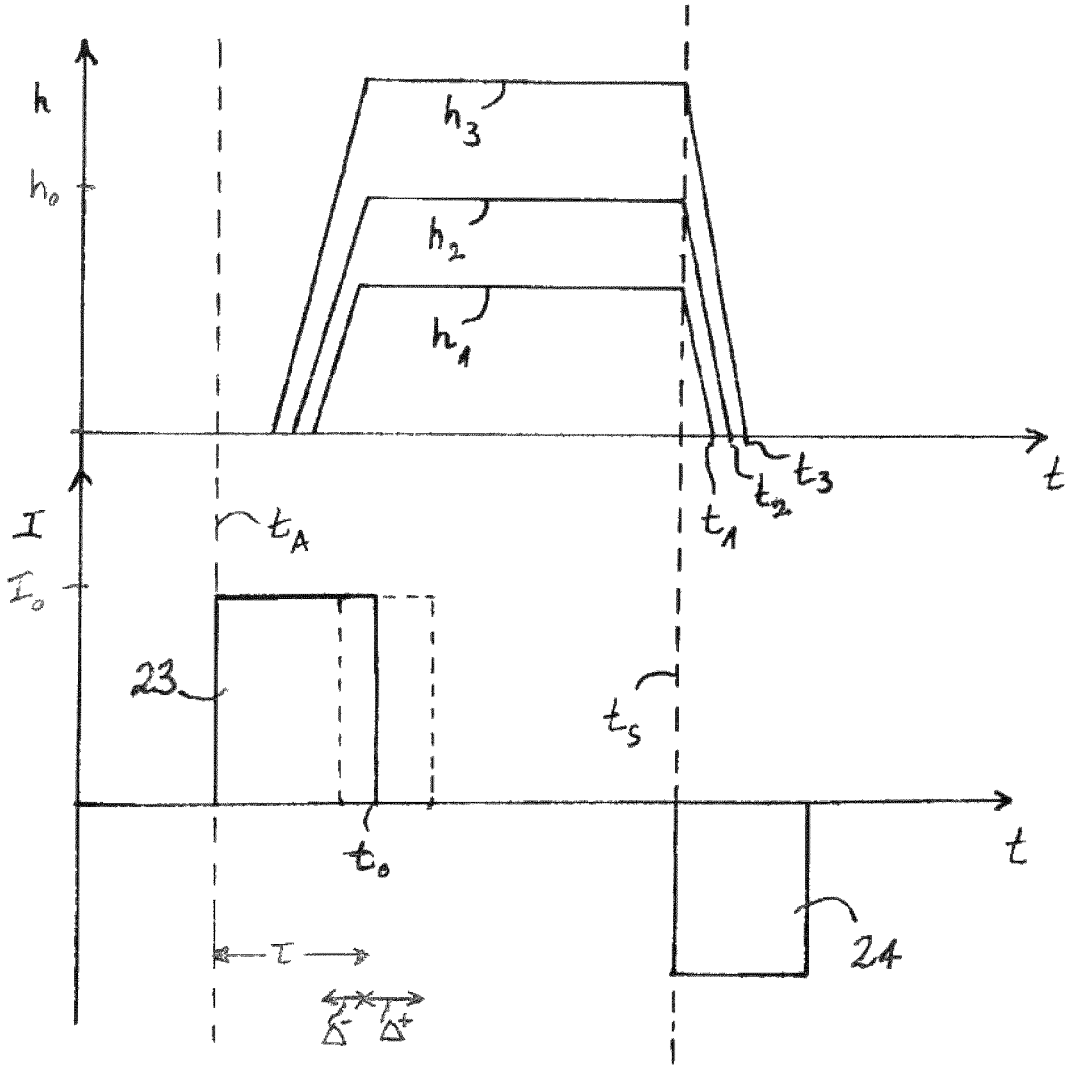
FIG. 3 shows time profiles of actual stroke heights of closing elements of three identical injection valves of the injection system shown in FIG. 1.

In FIG. 3 in the upper time diagram chronological profiles of stroke heights h of closing elements 4 of three of the identical injection valves 3 of the system are shown. The stroke heights which are shown are smaller than a limiting stroke height of the injection valves defined by a mechanical stop, with the result that only the lowest injection openings 5 are opened in each case. The individual injections which occur therefore each have only a reduced injection rate (seat-throttled operating mode).

In the lower time diagram, the time profiles of the charging current intensity I of the control signal 23 for opening, or of the control signal 24 for closing, the injection valves 3 are each illustrated schematically as continuous lines. In this case, in order to illustrate the control method the three injection valves are actuated at the same time $t_A$ with the same control signal 23 in order to open, to bring about the setpoint stroke height $h_0$. Synchronous actuation of the injection valves is, however, not necessary for the proposed method. The control signal 23 is provided in this simplified case by a charging current pulse with a constant charging current intensity $I_0$ and the charging duration $\tau=t_0-t_A$ with which the piezoactuators of the injection valves 3 are charged. It is apparent that despite identical actuation 23 the closure elements 3 are raised to different actual stroke heights $h_1$, $h_2$ and $h_3$.

After the actuation to open the injection valves there is a following holding period in which the closing elements 4 are held at the respectively achieved actual stroke heights $h_1$, $h_2$ and $h_3$. At the starting time $t_s$, the injection valves are actuated with the control signal 24 which is given by a charging current pulse. On the basis of the direct and virtually delay-free transmission of force between the piezoelements and the closing elements, the closing elements are each subjected, virtually without delay, to a closing movement in the direction of the respective closed position. However, it is apparent that owing to the different actual stroke heights $h_1$, $h_2$ and $h_3$ the closing elements impact in the respective closed positions at different closing times $t_1$, $t_2$ and $t_3$. The higher the actual stroke height which is achieved, the greater the time difference between the closing time $t_1$, $t_2$ and $t_3$ and the starting time $t_s$. This clarifies the above-mentioned unambiguous relationship between this time difference and the actual stroke height, with the result that this time difference can, as described above, be used as a measure for the stroke height and therefore also for the controlled variable.

In the example shown, for the purpose of illustration the actual stroke height $h_2$ is equal to the predefined setpoint stroke height $h_0$, with the result that the corresponding setpoint value of the time difference is given by $t_s-t_2$. Therefore, the control error for the injection valve, which has been raised to $h_2$, is equal to 0 at this individual injection. Consequently, for this injection valve there is subsequently no correction of the charging time $\tau$. For the injection valve which is raised to the actual stroke height $h_1$ there is a positive control error, $t_2-t_1>0$, with the result that in the subsequent individual injection there is an increase in the setpoint value of the charging energy and therefore also a prolongation of the charging time by the correction value $\Delta^+$ (see dashed line profile). For the injection valve which has been raised to the actual stroke height $h_3$ there is a negative control error, $t_2-t_3<0$ with the result that in the subsequent individual injection there is a reduction in the setpoint value of the charging energy and therefore a shortening of the charging time by the correction value $\Delta^-$ (see dashed line profile). This correction of the charging energy and of the charging duration is repeated subsequently if appropriate until the setpoint stroke height $h_2$ is achieved at least within predefined accuracy limits at each of the three injection valves. This is also referred to as equalization of the injection valves of the injection system.

What is claimed is:

1. A control method for an injection valve for injecting fuel into an internal combustion engine, the method comprising:

for a particular injection cycle, generating at least one control signal for actuating a drive of the injection valve comprising a piezoactuator as a function of a setpoint stroke height of a closing element of the injection valve, wherein the control signal is configured to actuate the drive to raise the closing element to the setpoint stroke height, and detecting at least one measurement variable correlated to an actual stroke height, determining the actual stroke height of the closing element resulting from the control signal as a function of the at least one measurement variable, and generating the control signal in at least one subsequent injection cycle as a function of a deviation of the actual stroke height from the setpoint stroke height during the particular injection cycle, wherein the at least one measurement variable is chosen from the group consisting of: a time difference between a closing time, at which the closing element impacts in a closing position, and a preceding starting time of a closing movement of the closing element in the direction of the closing position; an electrical capacitance of the piezoactuator at a time at which the closing element is at the actual stroke height; a pressure drop of the fuel triggered by the injection of the fuel; an injection rate of the fuel measured using a through-flow sensor of the injection valve; a change in a rotation speed of the internal combustion engine triggered by the injection; a change in a pressure in a cylinder of the internal combustion engine triggered by the injection; and a solid-borne sound of the cylinder triggered by combustion of the fuel injected into a cylinder of the internal combustion engine.

2. The method of claim 1, wherein at least one of a charging current intensity, a charging voltage, and a charging time for charging the piezoactuator is predefined by the control signal.

3. The method of claim 1, comprising, after actuating the drive with the control signal:

detecting an actual value of a second measurement variable which characterizes a state of the drive, and taking a deviation of this actual value from a setpoint value of the second measurement variable into account in the generation of the control signal in at least one subsequent injection cycle.

4. The method of claim 3, wherein the actual value of the measurement variable which characterizes the state of the drive is used as a controlled variable of a subordinate control loop.

5. The method of claim 3, wherein the second measurement variable corresponds to a charging energy of the piezoactuator.

6. The method of claim 1, wherein the piezoactuator moves the closing element and measures one or more of the at least one measurement variables correlated to the actual stroke height.

7. An injection system for injecting fuel into an internal combustion engine, comprising:

a control unit, and at least one injection valve with a closing element for closing the injection valve, wherein in a particular injection cycle, the control unit is configured to generate, as a function of a setpoint stroke height of the closing element, at least one control signal for actuating a drive of the at least one injection valve, wherein the drive comprises a piezoactuator configured to raise the closing element to the setpoint stroke height as a function of the control signal, wherein the control unit is further configured to:

detect at least one measurement variable correlated to an actual stroke height of the closing element, determine, based on the at least one measurement variable, an actual stroke height of the closing element resulting from the control signal, and generate a control signal in at least one subsequent injection cycle based on a deviation of the determined actual stroke height from the setpoint stroke height wherein the at least one measurement variable is chosen from the group consisting of: a time difference between a closing time, at which the closing element impacts in a closing position, and a preceding starting time of a closing movement of the closing element in the direction of the closing position; an electrical capacitance of the piezoactuator at a time at which the closing element is at the actual stroke height; a pressure drop of the fuel triggered by the injection of the fuel; an injection rate of the fuel measured using a through-flow sensor of the injection valve; a change in a rotation speed of the internal combustion engine triggered by the injection; a change in a pressure in a cylinder of the internal combustion engine triggered by the injection; and a solid-borne sound of the cylinder triggered by combustion of the fuel injected into a cylinder of the internal combustion engine.

8. The injection system of claim 7, wherein the control unit is configured to use the control signal to predefine at least one of a charging current intensity, a charging voltage, and a charging time for charging the piezoactuator.

9. The injection system of claim 7, wherein the control unit is configured to determine one or more of the at least one measurement variables correlated to the actual stroke height using electrical signals generated by the piezoactuator.

* * * * *